US005548933A

United States Patent [19]

Sharma et al.

[11] Patent Number: 5,548,933

[45] Date of Patent: Aug. 27, 1996

[54] FIXED ROOF TYPE FLAMMABLE LIQUID STORAGE TANK

[75] Inventors: Tribhuvan P. Sharma; R. S. Chimote, both of Roorkee, Ind.

[73] Assignee: Council Of Scientific & Industrial Research, New Delhi, Ind.

[21] Appl. No.: 259,776

[22] Filed: Jun. 14, 1994

[51] Int. Cl.[6] ..... E04H 7/06

[52] U.S. Cl. ..... 52/192; 169/68

[58] Field of Search ..... 52/192, 82; 169/66, 169/68

[56] References Cited

U.S. PATENT DOCUMENTS

| | | | |
|---|---|---|---|
| 236,203 | 1/1881 | Campbell | 169/68 |
| 1,770,623 | 7/1930 | Neumann | 169/66 X |
| 1,860,825 | 5/1932 | Thiede | 169/68 |
| 1,870,692 | 8/1932 | Schooler | 169/66 X |
| 2,692,649 | 10/1954 | McCreary | 169/68 X |
| 3,644,073 | 2/1972 | Goldsmith | 169/68 X |
| 4,893,681 | 1/1990 | Flandre | 169/68 X |

FOREIGN PATENT DOCUMENTS

| | | | |
|---|---|---|---|
| 960330 | 4/1950 | France | 169/68 |
| 575313 | 4/1933 | Germany | 169/66 |

OTHER PUBLICATIONS

"Foam Extinguishing Agents and Systems", Section 19/Chapter 4, pp. 19–32 to 19–48; Revised by Norman R. Lockwood, P.E., Fire Protection Handbook, Sixteenth Edition, Edited by Arthur E. Cote, P.E., Editor–in–Chief and Jim L. Linville, Managing Editor; National Fire Protection Association, Quincy, Massachusetts, U.S.A., First Impression: Mar., 1986.

"Dry Chemical Agents and Application Systems", Section 19/Chapter 3, pp. 19–24 to 19–31; Revised by Water Haessler, Fire Protection Handbook, Sixteenth Edition, Edited by Arthur E. Cote, P.E., Editor–in–Chief and Jim Linville, Managing Editor; National Fire Protection Association Quincy, Massachusetts, U.S.A., First Impression; Mar., 1986.

"Tank Construction", API Specifications 12B, 12D, 12F, and RP 12R1, American Petroleum Institute, Washington, D.C., Twelfth Edition (Jan. 1977), Ninth Edition (Jan. 1982), Eighth Edition (Jan. 1982) and Second Edition (Feb. 1981), Respectively.

*Primary Examiner*—Carl D. Friedman
*Assistant Examiner*—Yvonne Horton-Richardson
*Attorney, Agent, or Firm*—Pennie & Edmonds

[57] ABSTRACT

A fixed roof flammable liquid storage tank with a fire extinguishing device is disclosed. The tank has a hydraulically leakproof base, a conical slope ranging from 30° to 60° relative to the base, and a conical circular wall made of a plurality of metal plates joined together to form an upwardly tapered conical wall. The conical wall reaches up to a height where the top diameter reduces in the range of one-third to two-thirds of the base diameter of the tank to form a frustum. The tank is provided with a fire extinguishing device comprising one or more annular pipe rings connected by cross-member pipes with vertical discharge pipes attached at the junctions therebetween. The pipes extend above the highest level of the liquid in the tank and are configured to distribute either foam or dry chemical powder to extinguish a fire.

5 Claims, 5 Drawing Sheets

FIXED ROOF TYPE FLAMMABLE LIQUID STORAGE TANK

BACKGROUND OF THE INVENTION

The present invention relates to an improved fixed roof flammable liquid storage tank with a fire extinguishing device.

The improved fixed roof flammable liquid storage tank having a fire extinguishing device of the present invention pertains to the oil and petrochemical industries from the viewpoint of inherent fire safety for storing flammable liquids and the conservation of the petroleum product stored.

The present state-of-the-art for bulk storage of flammable liquids provides tanks which are governed principally by safety requirements and the need to operate economically when the tank is in service. The majority of tanks for the storage of petroleum in bulk are of mild steel welded construction, vertical cylindrical in shape. The tank design, fabrication, site erection, inspection and testing are fully specified in B.S. 2654: Part I, 1965 and Part II, 1961 and in API Standard 650. The British Standard relates to above ground tanks of the following designs:

"Non-pressure" fixed roof tanks (all sizes) suitable for working at atmospheric pressure, but designed for an internal pressure of 66 Kgf/m$^2$ and a vacuum of 63.5 Kgf/m$^2$ plus superimposed loads;

"Pressure" fixed roof tanks up to 30 m in diameter, suitable for an internal pressure of 203 Kgf/m$^2$ and a vacuum of 64.5 Kgf/m$^2$ plus superimposed loads;

Floating roof tanks of all sizes, i.e. open top tanks;

The "Non-pressure" fixed roof with internal floating deck tanks are used for the storage of both class "A" (flash point below 22.8° C.) and Class "B" (flash point between 22.8° C. and 65.6° C. both inclusive) petroleum;

"Non-Pressure fixed roof with" atmospheric vents, for both Class "B" and Class "C" (flash point above 65.6° C.) petroleum; and "Pressure" fixed roof tanks for Class "A" petroleum only.

The most common of the presently available storage tanks are:

Supported cone roof: a roof formed to approximately the surface of a right cone, with its principal support provided by either rafters on girders and columns or rafters;

Self-supporting cone roof: a roof supported only at its periphery;

Self-supporting dome roof: a roof formed to approximately a spherical shape, supported only at its periphery; and Self-supporting umbrella roof: a modified dome roof so formed that any horizontal section is a regular polygon with as many sides as there are roof plates, supported only at its periphery.

All these roofs provide reduction in the loss of flammable vapors. The salient features of the various storage tanks available are compared in Table 1 with what is termed as an "Ideal Tank" wherein each of the five fire safety rating factors receives 20 points or a total fire safety rating of 100.

An ideal tank would be such a pressure vessel in which all venting is eliminated thus containing fully the flammable compound and adequately spaced or otherwise protected to prevent exposure to fire. Such a tank would seem to be economically impractical, but it is used for rating purposes only.

TABLE 1

Fire Safety Ratings, conservation Type Tanks Vs. Standard Fixed Cone Roof Tank as per Fire Protection Manual, Second Edition, Edited by Charles H. Vervalin, Gulf Publishing Company, Book Division, Houston, Texas, 1973

| S. No. | Type of Tank | Susceptibility to explosion | Susceptibility to fire from venting of vapors | Susceptibility to damage from fire exposure | Dependence on fire fighting efficiency | Dependence for safety on mechanical appurtenances | Fire safety rating |
|---|---|---|---|---|---|---|---|
| 1. | *Ideal Tank | 20 | 20 | 20 | 20 | 20 | 100 |
| 2. | *Unprotected Cone Roof Tank (FIG. 1) | 0 | 0 | 0 | 0 | 20 | 20 |
| 3. | *Standard Cone Roof Tank (FIG. 2) | 5 | 5 | 5 | 5 | 15 | 35 |
| 4. | *Variable Vapor Space Tank With Inert Gas (FIG. 3) | 20 | 10 | 10 | 10 | 10 | 60 |
| 5. | Breather Roof Tank (FIG. 4) | 20 | 15 | 10 | 10 | 5 | 60 |
| 6. | Balloon Roof Tank (FIG. 5) | 15 | 10 | 15 | 10 | 10 | 60 |
| 7. | Cone Roof Tank with Inert Gas and and Water Cooling (FIG. 6) | 20 | 10 | 15 | 10 | 5 | 60 |
| 8. | *Lifter Roof | 20 | 10 | 10 | 10 | 10 | 60 |

TABLE 1-continued

Fire Safety Ratings, conservation Type Tanks Vs. Standard Fixed Cone Roof Tank as per Fire Protection Manual, Second Edition, Edited by Charles H. Vervalin, Gulf Publishing Company, Book Division, Houston, Texas, 1973

| S. No. | Type of Tank | Susceptibility to explosion | Susceptibility to fire from venting of vapors | Susceptibility to damage from fire exposure | Dependence on fire fighting efficiency | Dependence for safety on mechanical appurtenances | Fire safety rating |
|---|---|---|---|---|---|---|---|
| | Tank (FIG. 7) | | | | | | |
| 9. | *Noded Spheroid (FIG. 8) | 20 | 15 | 15 | 10 | 10 | 70 |
| 10. | *Floating Diaphragm Tank (FIG. 9) | 15 | 20 | 10 | 10 | 20 | 75 |
| 11. | *Pan Type Floating Roof Tank (FIG. 10) | 20 | 15 | 20 | 20 | 10 | 85 |

The drawbacks of the presently available flammable liquid storage tanks are:

In comparing the various tanks available with the ideal tank, each is penalized to the extent of the apparent existing fire safety problem. In the case of an unprotected cone roof tank as shown in FIG. 1 of the drawings accompanying this specification, the drawback is that it is having inadequate vent devices, no flame arrester and inadequate spacing, and has a fire safety rating of only 20. This is the lowest fire safety rating received by any type of tank by virtue of its fire safety features. Next lowest in fire safety rating is the standard cone roof tank, as shown in FIG. 2 of the drawings accompanying this specification, having a fire safety rating of 35. The major drawback of this standard cone roof tank is that it is highly susceptible to explosion, to fire from venting of vapours, to damage from fire exposure, and is having greater dependence on fire fighting efficiency and for safety on mechanical appurtenances. The variable vapor space tank as shown in FIG. 3 with inert gas protection receives a fire safety rating of 60. The drawback of this variable vapor space tank is that there is a greater possibility of fire from venting of vapors. The variable vapor space tank as depicted in FIG. 3 is considered to be more susceptible to damage by fire exposure but less dependent on mechanical appurtenances than the cone roof tank with inert gas protection as shown in FIG. 6. The breather roof tank as depicted in FIG. 4 receives a fire safety rating of 60; the drawback of this breather roof tank is that since its roof operates by metal bending, it often leads to cracking of the roof sheets, which further adds several drawbacks of its greater susceptibility to damage from fire exposure and greater dependence for fire safety on mechanical appurtenances and on fire fighting efficiency. FIG. 5 shows the balloon roof tank which rates with a fire safety rating of 60 with a major drawback of the cracking of the roof sheets because of metal bending operation. The other drawbacks that follow are its greater susceptibility to fire from venting of vapours because its roof has a larger diameter than the tank which provides greater displacement capacity than its relative breather roof; and higher susceptibility to damage from fire exposure with a greater dependence for safety on mechanical appurtenances and on fire fighting efficiency. The water cooled, inerted cone roof tank as shown in FIG. 6 has a fire safety rating of 60 with a major drawback that there is a greater possibility of fire from venting of vapours. The lifter-roof tank, as depicted in FIG. 7 rates with a fire safety rating of 60 because the possibility of fire from venting of vapours is greater in this tank. The noded spheroid as shown in FIG. 8 is used for storage of oils under pressure, as is required for some casinghead gasolines, butane, and butane blends etc. and is suitable for working pressures up to 1.70 bar. The drawback of this noded spheroid is that it is more dependent for fire safety on mechanical appurtenances and on fire fighting efficiency. Floating diaphragm tank as shown in FIG. 9 rates high with a fire safety rating of 75, as it eliminates practically all vapour losses and is reasonably independent of mechanical appurtenances for safety. The major drawback of the floating diaphragm tank is that there is a possibility of vapour leakage past the diaphragm, which could cause an explosive mixture in the vapour space and has a reasonable susceptibility of the diaphragm to damage from fire exposure, and therefore, has greater independence on fire fighting efficiency. The pan type floating roof tank, as depicted in FIG. 10, has the highest fire safety rating of 85 because the large majority of the fire safety deficiencies involving bulk storage have been eliminated. But its major drawback is its dependence on maintaining a reasonably tight seal because of mechanical appurtenances and reasonable susceptibility to fire from venting of vapours.

The present state-of-the-art of floating roof tanks with emphasis on minimizing seal gaps, as reported by Mr. J. C. Thompson in his article on "Floating Roof Tank Safety Features", states that the environmental requirements should still further improve the fire safety record of floating roof tanks. However, there is a cloud on the horizon, the secondary seal, which has been around for a long time; but in the past, it was usually shoe-mounted with very little vapour space, but now deck-mounted-to-shell secondary seals have much larger enclosed vapour space which pose a threat of greater fire hazards in floating roof tanks in long runs. However, this fire safe tank conserves petroleum product through decreased vapourisation. The gross savings can be applied to amortize the increased cost and defray the increased depreciation and maintenance. FIGS. 1 to 10 thus illustrate the present/prior arts of the types of tanks used for the storage of flammable liquids.

Indian Patent no. 129753 relates to a storage silo construction. This storage silo particularly pertains to the bulk storage of grain and other cereal crops. The details are as shown in FIGS. 11 to 14 of the drawings accompanying this specification.

The storage silo construction is for the storage of grain and other cereal crops, having conical of frusto-conical wall, capable of being fabricated substantially at the ground level, the top of the conical walls being provided with roofing sheets to form a roof of generally conventional design having an opening through which the grain to be stored in the silo is fed by means of an elevator and a conveyor system; the periphery of the roof is being connected to hoisting devices, preferably being electrically operated screw jacks, evenly spaced therearound; the floor of the silo is formed so as to slope upwardly and outwardly from either side of a central valley or trough, details of the trough being seen best in FIG. 13 of the drawings accompanying this specification; the trough comprises a plurality of reinforced concrete channels of U-section located end-to-end in the base of the silo; the floor of the silo being a stabilized earth fill provided with a layer of a premixed anionic bitumen-emulsion and sand, and covered with sheet metal plates welded together, the lowermost panels extending over the sides of the concrete channels so as to form a plurality of hoppers or the like having discharge outlets; each of discharge outlets is provided with a closure plate which can be operated to open and close the discharge outlet as desired; immediately below the discharge outlets runs an endless conveyor belt serving to remove the grain from the silo to a discharge location outside the silo.

The drawbacks of the storage silo construction as described above are as under:

(1) The removable roof of this storage silo construction is of a conventional design and constructed in a conventional manner and particularly suitable for the storage of grain and other cereal crops. With a particular reference to the storage of flammable liquids, the roof is highly susceptible to fire and/or explosion. This is because of the following reasons:
   (a) The removable roof has electrically operated devices for lifting of the roof. These devices are potential fire hazards as these can cause electrical sparks;
   (b) The roof provided is not leakproof to flammable liquid vapours.

(2) The silo is dependent on external fire fighting arrangements and as such is unsuitable for the storage of flammable liquids.

(3) The bottom of the storage silo construction, being made for the storage of grain and other cereal crops, does not offer enough stability and tightness required for the storage of flammable liquids.

(4) The wall of the conical shell of the storage silo construction, being made for the storage of grain and other cereal crops, is not hydraulically leakproof for the storage of flammable liquids.

With the above noted drawbacks in mind, a tank of the type of the storage silo construction described above if used for storing flammable liquids would have the lowest fire safety rating of only about 20, considering 80 penalty points altogether for susceptibility to fire and explosion, dependence on fire fighting efficiency and electrical/mechanical appurtenances, which from fire safety point of view single it out as totally unsuitable for the storage of flammable liquids.

The present state-of-the-art of extinguishment of oil fires in fixed/floating roof storage tanks implies use of foam and/or dry chemical powder.

The drawbacks associated with the presently available fire extinguishing devices are:

Singly or in combination, foam and/or dry chemical powder fire extinguishants are presently being used for the extinguishment of flammable liquid storage tank fires, either by top surface application or by subsurface/semi-subsurface applications. The drawback of top surface application is that when the roof of the fixed/floating roof tank gets blown off, the top surface application device(s) gets damaged and is unable to perform its function. In case of subsurface/semi-subsurface application, the foam bubbles carry along with them the flammable liquid and thus add to the fire. Moreover, the foam bubbles get broken off due to immediate heat contact and increase in the surface tension of the bubble surface because of the embedded flammable liquid; thus fueling sufficiently further to the fire and ultimately, rendering themselves ineffective in extinguishing the fire; whereas in case of the dry chemical powder, the major drawback is that it can not be applied by using subsurface semi-subsurface application methods.

The prior art discussed in above paragraphs were brought about during the course of time by the necessity for fire safety and conservation of petroleum products, and each of them has drawbacks as detailed above.

BRIEF DESCRIPTION OF THE DRAWINGS

There are various types of cylindrical steel welded tanks. These are as illustrated in FIGS. 1 to 10 of the drawings accompanying this specification.

SUMMARY OF THE INVENTION

Figure 1:
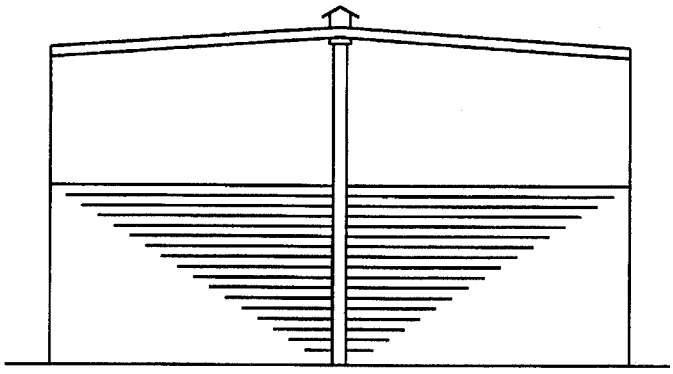
FIG. 1 shows a side view of the unprotected cone roof tank.
Figure 2:
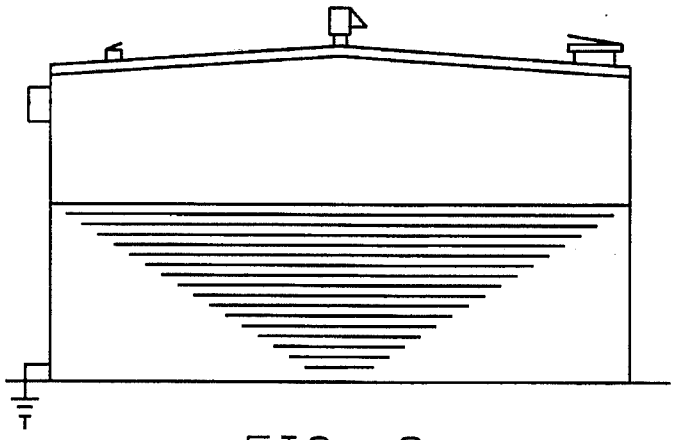
FIG. 2 depicts side view of the standard cone roof tank.
Figure 3:
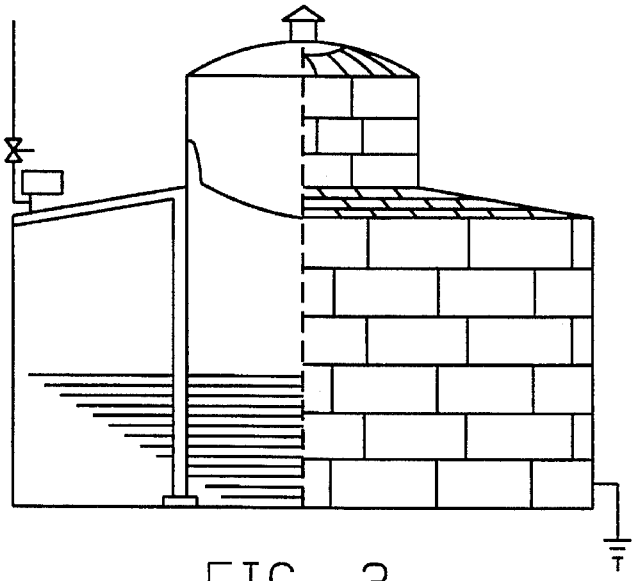
FIG. 3 shows side and section view of the variable vapor space tank.
Figure 4:
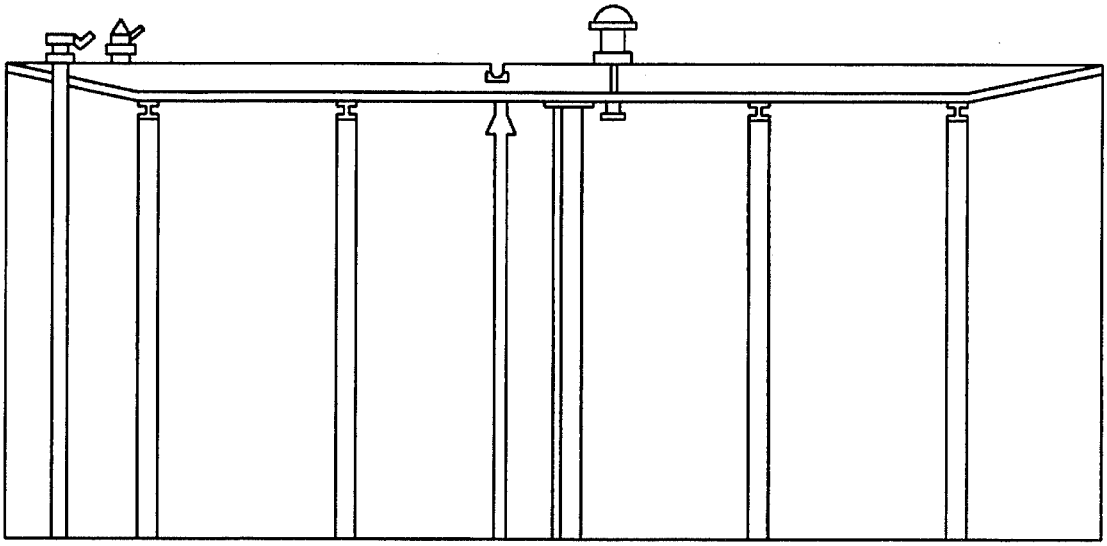
FIG. 4 depicts side view of the breather roof tank.
Figure 5:
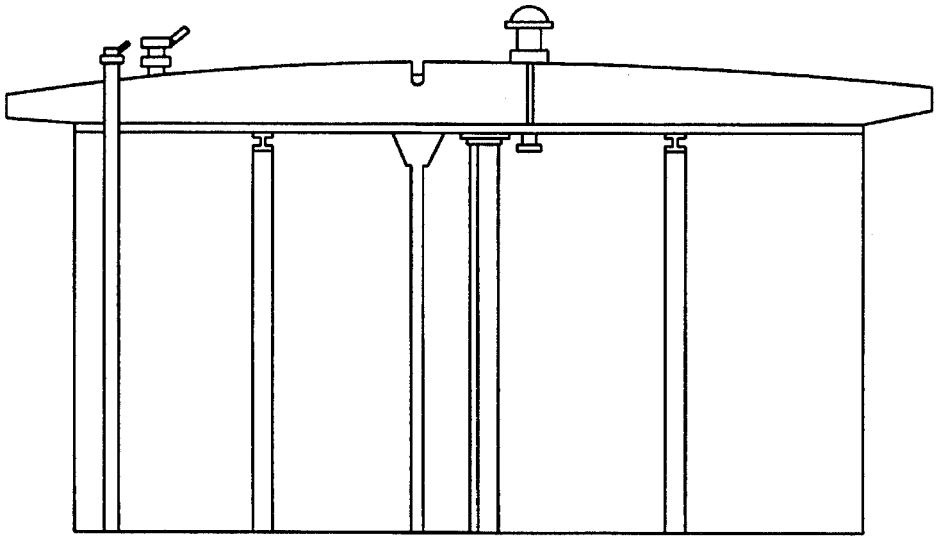
FIG. 5 shows side view of the balloon roof tank.
Figure 6:
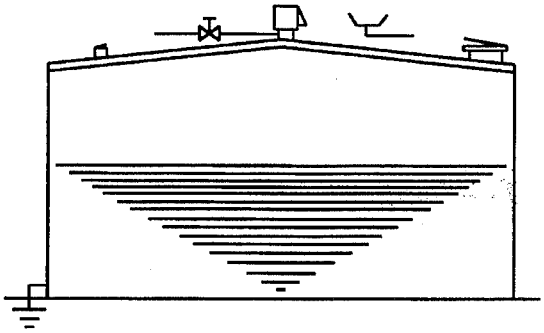
FIG. 6 depicts side view of the cone roof tank with inert gas and water cooling.
Figure 7:
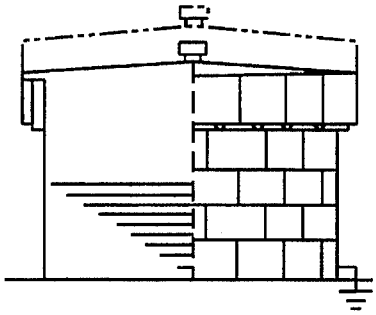
FIG. 7 shows side and sectional view of the lifter roof tank.
Figure 8:
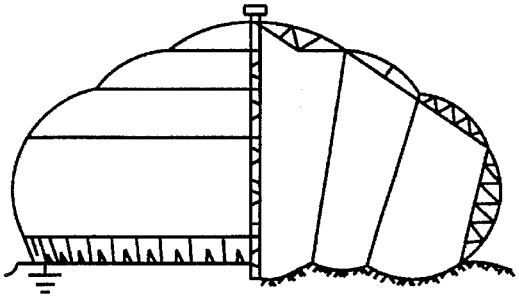
FIG. 8 depicts side and section view of the noded spheroid.
Figure 9:
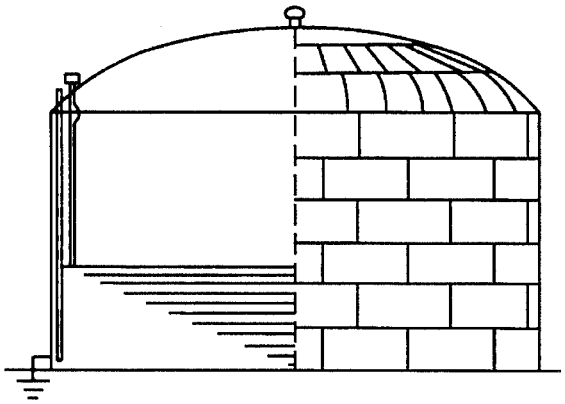
FIG. 9 shows side and sectional view of the floating diaphragm tank.
Figure 10:
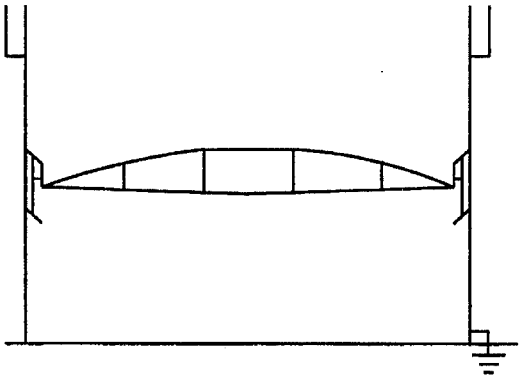
FIG. 10 depicts side and sectional view of the pan type floating roof tank.
Figure 11:
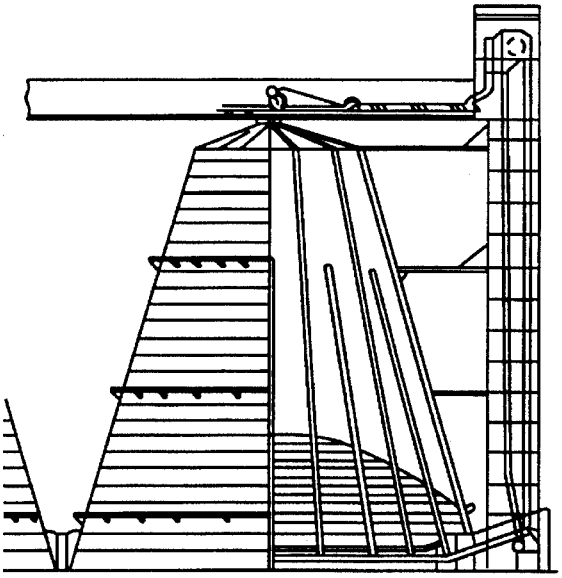
FIG. 11 depicts a side elevation partly in section of one form of the silo according to the invention.
Figure 12:
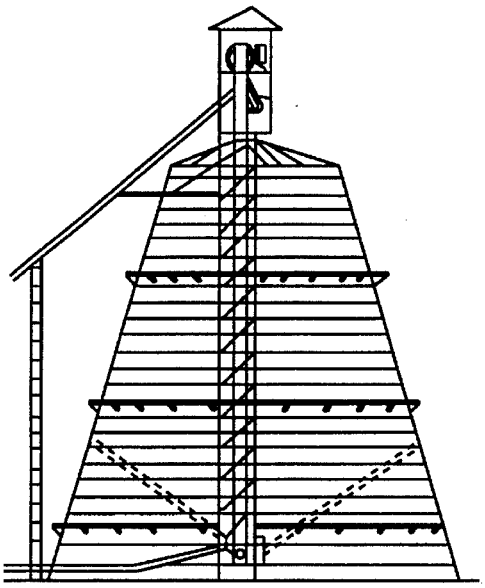
FIG. 12 shows a further side elevation of the silo shown in FIG. 11.
Figure 13:
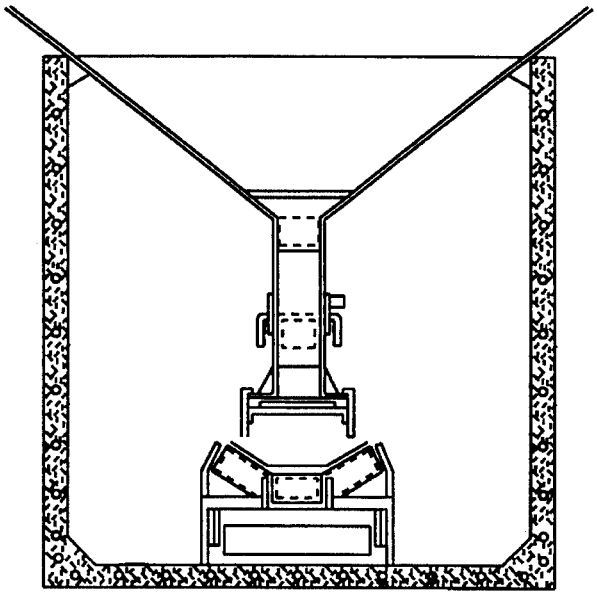
FIG. 13 depicts a section through the discharge outlet at the bottom of the silo.
Figure 14:
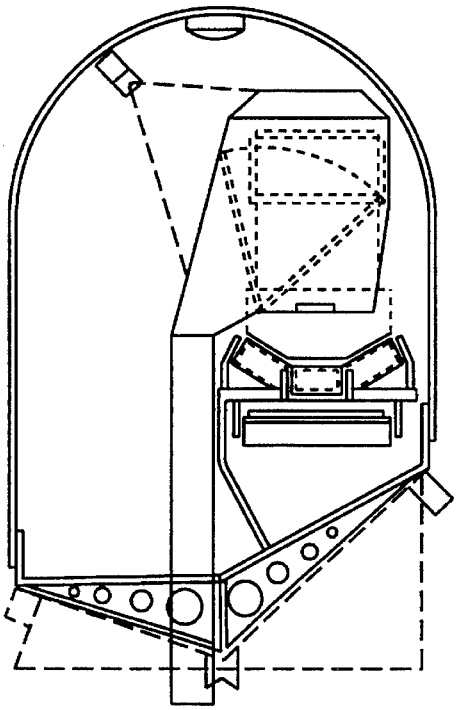
FIG. 14 shows a section through the conveying arrangement for feeding material into the top of the silo.

The main object of the present invention is to obviate the above noted drawbacks and to provide an improved fixed roof flammable liquid storage tank with a fire extinguishing device so as to have a fire-safe storage of flammable liquids, having increased fire safety and conservation of petroleum product stored.

We have found by extensive research work in the field that when a tank of the conical constructional features having provided with a fixed conical roof is used for the storage of flammable liquids, reduces the fire radiation intensity to about one-fourth than that of a cylindrical tank having same height and the same storage capacity. Moreover, it also reduces air entrainment to a considerable extent as compared to the cylindrical tank because of its conical construction, thus suffocating the fire and thereby reducing the rate of burning. Further it will be easier to extinguish the fire as the size of fire will be considerably smaller than that of the cylindrical tanks. Moreover, it will be more stable as compared to cylindrical tanks as the base area will be about 9/4 times higher than that of the tank of the same height and the same storage capacity. The top cross-sectional area will be about one-fourth, depending upon the base-to-top diameter ratio. The fire extinguishing device being inbuilt in the storage tank is highly efficient in extinguishing fires of flammable liquids using foam and/or dry chemical powder extinguishants. For the fire of size 0.33 sq.m, the device, using foam as a fire extinguishing agent, takes about 4 to 5 seconds to extinguish the fire completely; and using dry chemical powder, the device takes about 3 to 3.5 seconds to knock down the fire completely. Besides these advantages, the storage tank of the present invention is simple and economical to fabricate and install with a minimum of labour and higher job safety, as well as to provide increased fire safety and security by minimizing the degree of fire hazards. Thus, altogether, it receives a fire safety rating of 95 by penalizing only 5 points in dependence for safety on mechanical appurtenances.

DESCRIPTION OF THE PREFERRED EMBODIMENT

Accordingly, the present invention provides an improved fixed roof flammable liquid storage tank (1) with a fire extinguishing device (2), which comprises a conical tank of slope ranging from 30° to 60° to the base, having a stable and hydraulically leakproof bottom, and a conical circular wall (3) made of plurality of metal plates (4) joined together in continuation and in alignment to form upwardly and inwardly tapered conical wall up to a height where the top diameter reduces in the range from one-third to two-third of the base diameter of the tank to form a frustum (8); the joining of metal plates being done in the manner so as to form leakproof joints (26) aligning toward the centre of the tank; the wall plates are secured to a plurality of vertically spaced ring trusses (6), the diameter of which decreases in relation to the sloping angle as the distance from the base of the tank increases; the conical shell section of the tank is raised on a tier by tier basis up to a predetermined height by the hoisting means (5); the top of the frustum having a pneumatically leakproof conical roof (7) of slope ranging from 3° to 4° to the frustum fixed to it; the fixing of the roof being made on the roof supporting structure consisting of columns (16), girders (24), rafters (25) and/or girder rings; the tank being provided with a fire extinguishing device consisting of one or more annular pipe ring(s) (9), capable of being fixed horizontally, concentrically and equidistantly to each other, just above the bottom of the storage tank, the outermost annular pipe ring(s) being connected to means for supplying foam/dry chemical powder, the annular pipe ring(s) having a plurality of diametrically connected cross-member pipes (12), the junctions of the annular pipe ring(s) and cross-member pipes being provided with vertical discharge pipes (13) of height such that the top ends of the pipe are above the highest level (22) of the flammable liquid (23) in the storage tank; the vertical discharge pipes having discharge nozzles (14) fixed to its top ends for uniform discharge of foam/dry chemical powder onto the surface of the flammable liquid in the storage tank; the frustum of the said tank also being provided at its top with an emergency vent (15), a conservation vent and flame arrester (17), means for a water spray system (18), gauge hatch (19) and an inert gas vent (20), the tank also being provided with means for earthing (21).

The storage tank of the present invention is constructed as per the following steps:

(i) assembling the tank bottom by laying the flat sheet metal plates on the pad and joining temporarily by the tack welds so as to form a circular perimeter of the stable tank bottom;

(ii) forming an upwardly tapered conical tank shell section within the sloping-up angle range of 30° to 60° over the circular perimeter of the tank bottom by combining in continuation the first plurality of the first course of rectangular wall plates by tack-welding to the bottom plates, the sloping-up joints between the shell plates are welded, and this is followed by the complete welding of the first course to the bottom plates, finally, all the bottom plates are welded together;

(iii) testing the tank bottom hydraulically for stability and tightness to flammable liquid storage, if any leaks are found, the defective welds are cut out and replaced till the satisfactory testing of the tank bottom is completed;

(iv) fixing outwardly and inwardly the first supporting ring truss(s) (6) to the said tapered conical tank shell section;

(v) raising the conical tank shell section so formed, by means of suitable hoisting devices(5)/stiffening members fixed to the said tapered conical tank shell section;

(vi) installing and combining in continuation and in proper alignment a further plurality of rectangular flat sheet metal small plates (9) with their longer horizontal side being placed above the said first plurality of the first course of shell plates so as to form on a tier by tier basis a continuation of a number of courses or strakes of shell plates of the said tapered conical tank shell section;

(vii) locating-and installing firmly a further supporting ring truss(s) (6) of smaller diameter than the first ring truss(s) around the said further plurality of shell plates;

(viii) repeating the steps (v), (vi) and (vii) until the desired height, where the top diameter of the tank reduces in the range of one-third to two-third of the tank base diameter is reached;

(ix) installing the fire extinguishing device (2) as detailed in the preceding paragraphs;

(x) forming a top angle in the range of 3° to 4° to connect the first plurality of tank roof plates and the tank shell so as to form an upwardly tapered conical roof section;

(xi) installing the plurality of structural steel or steel pipe columns (16) by evenly spacing over the area of the tank and resting on the tank bottom, and arranging and installing the plurality of steel girders (24) and rafters (25) and/or girder rings so as to form a support to the plurality of roof plates of the tank roof; the smaller tanks, similar to production tank design, have only a centre column, with no girders; larger tanks must have several girder rings depending upon top diameter of a tank;

(xii) combining in continuation and in proper alignment a further plurality of roof plates with the said first plurality of roof plates by laying them over the roof supporting structure so as sloping up toward the centre of the tank in the slope-angle range of 3° to 4°, preferably of 3.6°;

(xiii) repeating the step (xii) until the complete roof is installed;

(xiv) testing the roof pneumatically for tightness to flammable liquid vapours until the pressure in the range of 40 kg/m$^2$ to 50 kg/m$^2$ is reached;

(xv) testing the whole storage tank hydraulically for stability and tightness to flammable liquid storage;

(xvi) installing necessary storage tank accessories and safety means as required.

The fire extinguishing device fitted inside the conical tank has been described and claimed in our co-pending U.S. application Ser. No. 08/259,777. In the fire extinguishing device, the number of annular pipe rings ranges from one to cube root or the nearest whole number, of the diameter of the storage tank. The outermost annular pipe ring is fixed at a minimum distance of 1 metre from the storage tank wall. The annular pipe ring(s) is fixed at a distance in the range of 0.15 m to 0.5 m from the bottom of the storage tank. The number of cross-member pipes is in the range of 2 to the number of annular pipe rings. The height of the vertical discharge pipes being such that the top ends of the discharge pipes, to which are fixed the discharge nozzles, are at a distance ranging from 15 cm to 30 cm above the highest level of the flammable liquid in the storage tank. In case of injecting foam, the diameter of pipes for annular rings and cross-members will range from 150 mm to 250 mm, and for vertical discharge pipes from 100 mm to 200 mm. In case of injecting dry chemical powder, the diameter of pipes for annular rings and cross-members will range from 50 to 75 mm, and for vertical discharge pipes from 25 mm to 50 mm. The fire resistant/fire retardant material used for treating the annular pipe ring(s), cross-member pipes, vertical discharge pipes, discharge nozzles, valve, foam generator or a dry chemical powder discharge arrangement and pipe fittings and accessories must have a fire resistance rating in the range of half-an-hour to one hour.

The conical roof (8) of the said tank also being provided at its top with a conservation vent & flame arrester (17), an emergency vent (15), means for a water spray system (18), an inert gas vent (20), and a gauge hatch (19). The storage tank is also being provided with means for earthing (21).

Figure 15:
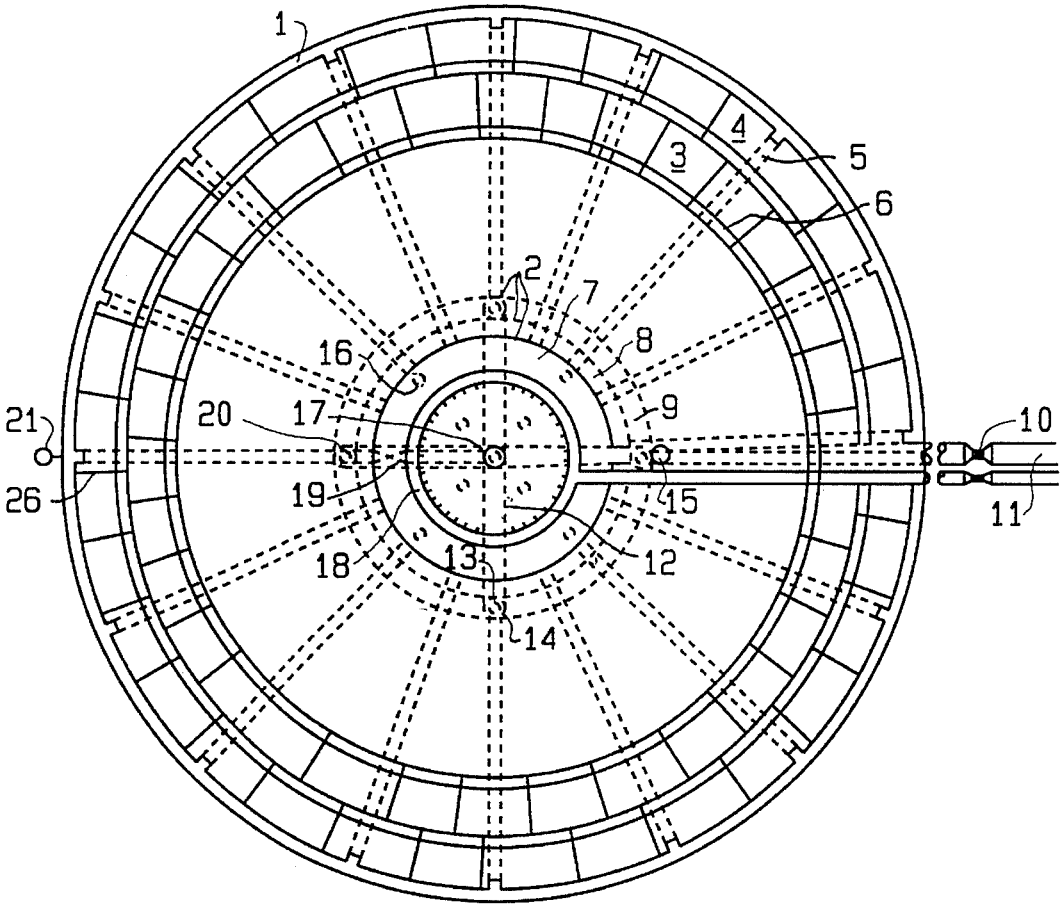
FIGS. 15 and 16 are showing the storage tank of the present device.

The storage tank of the present invention is explained with reference to the FIG. 15 and FIG. 16 of the drawings accompanying this specification. FIG. 15 depicts the top view and the FIG. 16, the front view of the storage tank of the present invention.

The tank (1) is a conical above ground flammable liquid storage construction, being fixed with a conical roof (8) onto its top. The correlation of height of the tank (1) lies at such a vertical distance above the bottom of the tank (1) where the top surface diameter of the tank parallel-to-tank base reduces in the range of one-third to two-third of the base diameter of the tank (1).

The correlation of the conical tank (1) and conical roof (8) is in terms of the slope-angle. The slope of the conical tank (1) ranges from 30° to 60°. The sloping-up conical roof (8) of the tank (1) has a slope in the range of 3° to 4°.

The fire extinguishing device (2) consists of at least one horizontally placed annular pipe ring (9). The number of annular pipe rings (9) depends on the diameter of the storage tank which is to be protected against fire hazards. The maximum number of annular pipe ring(s) (9) is determined by the cube root or the nearest whole number, of the diameter of the storage tank. The diameter of the annuli will depend on the storage tank (1) diameter. The outermost annular pipe ring (9) being fixed at a minimum distance of 1 metre from the tank (1) wall. In the case of multiple annular pipe rings (9) the next inner annular pipe ring(s) (9) being fixed equidistantly from each other. The annular pipe ring(s) (9) being fixed horizontally at a distance in the range of 0.15 metre to 0.5 metre from the bottom of the storage tank (1). The annular pipe ring(s) (9) is/are connected diametrically by cross-member pipes (12) for uniform distribution of foam/dry chemical powder to all the vertical discharge pipes (13). The number of cross-member pipes (12) will range from 2 to the number of annular pipe rings (9). At the junction of the annular pipe ring(s) (9) and the cross-member pipes (12) are fixed with the vertical discharge pipes (13) for carrying and discharging the foam/dry chemical powder onto the surface of the flammable liquid (23) stored in the tank (1). The height of the vertical discharge pipes (13) being such that the top ends of the pipes (13) are in the range of 15 cm to 30 cm above the highest level (22) of the flammable liquid (23) in the storage tank (1). At the top ends of the vertical discharge pipes (13) are fixed the discharge nozzles (14) for uniform discharge of foam/dry chemical powder.

The type of discharge nozzles (14) used in the case of foam extinguishing is of the size ranging from 100 mm to 200 mm. The type of discharge nozzles (14) used in the case of dry chemical powder extinguishment is of the size ranging from 25 mm to 50 mm.

The annular pipe ring(s) (9) is connected through a valve (10) to foam generator(s) (11) or a dry chemical powder discharge arrangement (11).

Figure 16:
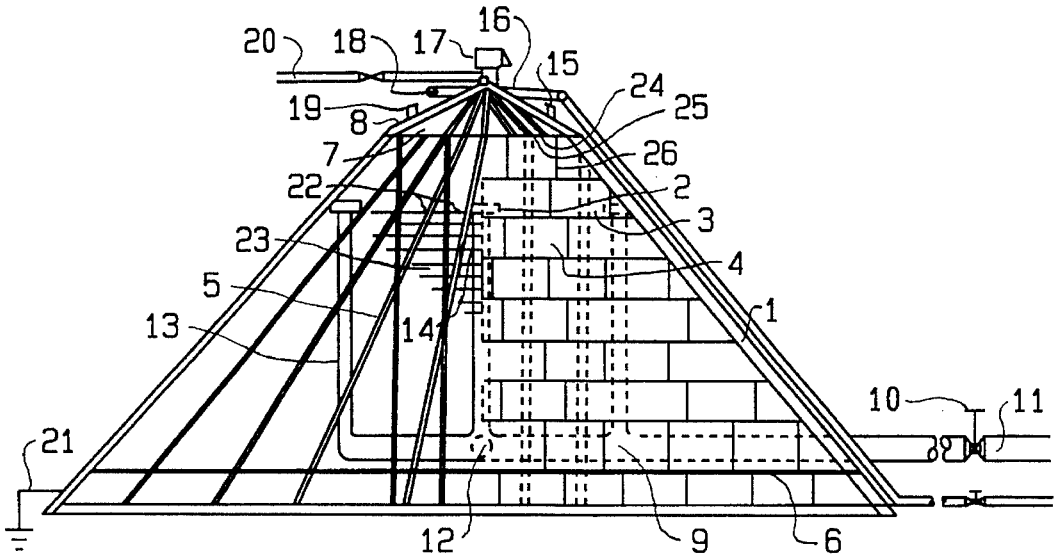

The annular pipe ring(s) (9), cross-member pipes (12), vertical discharge pipes (13), discharge nozzles (14), valve(s) (10), foam generators (11) or a dry chemical powder discharge arrangement (11) and pipe fittings & accessories being provided for the construction of the device as shown in FIGS. 15 and 16, are treated with fire resistant/fire retardant material. The fire resistance rating of the fire resistent/fire retardant material being used for the treatment is in the range of half-an-hour to one hour.

The other safety features of the storage tank (1) are: an emergency vent (15), a conservation vent and flame arrester (17), a water spray system (18), an inert gas vent (20), a gauge hatch (19), and means for earthing (21).

The fire extinguishing device is used as follows:

The device as described above, is duly installed inside the storage tank (1) and connected to foam generator(s) (11) dry chemical powder (DCP) discharge arrangement (11). The actuation of foam generator(s) (11)/DCP discharge arrangement (11) is initiated automatically by rate-of-temperature rise/flame/heat sensors installed strategically inside the tank (1) to sense the occurrence of fire inside the tank (1) or manually by operating the power switch. As a result, in the event of fire the foam/DCP discharge occurs automatically and the same is being uniformally discharged inside the tank (1) onto the surface (22) of the flammable liquid (23) stored in the tank (1) for the extinguishment of fire.

The fire extinguishing device can be installed for foam/dry chemical powder injection either singly or in combination depending upon the degree of fire hazards to be protected and the fire protection arrangement, therefore, required to be provided in order to accomplish the higher tank fire safety levels.

The following examples are given to illustrate the present invention and should not be construed to limit the scope of the invention.

Example 1

Fire was set on using petrol as a flammable liquid in a mild steel and of welded construction tank (1) of size: 1950 mm base diameter by 650 mm top surface diameter by 728 mm height having a slope of 48°. The top of the conical tank was at a height where the top surface diameter of the frustum reduced to one-third of the base diameter of the tank. The top surface diameter and the base diameter of the tank are in the ratio of 1:3. Volumetrically, this conical tank (1) is equivalent to a cylindrical tank of 1300 mm diameter and of the same height; thereby reducing the degree of radiation fire hazards by approximately one-fourth as that of what prevails in the cylindrical tank of the diameter 1300 mm and of the same storage capacity. The fire of size 0.33 sq.m was extinguished in 5 seconds using foam as a fire extinguishing agent.

Example 2

Fire was set on using diesel as a flammable liquid in a mild steel and of welded construction tank (1) of size: 1950 mm base diameter by 650 mm top surface diameter by 728 mm height having a slope of 48°. The top of the conical tank was at a height where the top surface diameter of the frustum reduced to one-third of the base diameter of the tank. The top surface diameter and the base diameter of the tank are in the ratio of 1:3. Volumetrically, this conical tank (1) is equivalent to a cylindrical tank of 1300 mm diameter and of the same height; thereby reducing the degree of radiation fire hazards by approximately one fourth as that of what prevails in the cylindrical tank of the diameter 1300 mm and of the same storage capacity. The fire of size 0.33 sq.m was extinguished in 4 seconds using foam as a fire extinguishing agent.

Example 3

Fire was set on using kerosene as a flammable liquid in a mild steel and of welded construction tank (1) of size: 1950 mm base diameter by 650 mm top surface diameter by 728 mm height having a slope of 48°. The top of the conical tank was at a height where the top surface diameter of the frustum reduced to one-third of the base diameter of the tank. The top surface diameter and the base diameter of the tank are in the ratio of 1:3. Volumetrically, this conical tank (1) is equivalent to a cylindrical tank of 1300 mm diameter and of the same height; thereby reducing the degree of radiation fire hazards by approximately one fourth as that of what prevails in the cylindrical tank of the diameter 1300 mm and of the same storage capacity. The fire of size 0.33 sq.m was extinguished in 4 seconds using foam as a fire extinguishing agent.

Example 4

Fire was set on using mobil oil as a flammable liquid in a mild steel and of welded construction tank (1) of size: 1950 mm base diameter by 650 mm top surface diameter by 728 mm height having a slope of 48°. The top of the conical tank was at a height where the top surface diameter of the frustum reduced to one-third of the base diameter of the tank. The top surface diameter and the base diameter of the tank are in the ratio of 1:3. Volumetrically, this conical tank (1) is equivalent to a cylindrical tank of 1300 mm diameter and of the same height; thereby reducing the degree of radiation fire hazards by approximately one fourth as that of what prevails in the cylindrical tank of the diameter 1300 mm and of the same storage capacity. The fire of size 0.33 sq.m was extinguished in 4 seconds using foam as a fire extinguishing agent.

Example 5

Fire was set on using petrol as a flammable liquid in a mild steel and of welded construction tank (1) of size: 1950 mm base diameter by 650 mm top surface diameter by 728 mm height having a slope of 48°. The top of the conical tank was at a height where the top surface diameter of the frustum reduced to one-third of the base diameter of the tank. The top surface diameter and the base diameter of the tank are in the ratio of 1:3. Volumetrically, this conical tank (1) is equivalent to a cylindrical tank of 1300 mm diameter and of the same height; thereby reducing the degree of radiation fire hazards by approximately one fourth as that of what prevails in the cylindrical tank of the diameter 1300 mm and of the same storage capacity. The fire of size 0.33 sq.m was extinguished in 3.5 seconds using dry chemical powder as a fire extinguishing agent.

Example 6

Fire was set on using diesel as a flammable liquid in a mild steel and of welded construction tank (1) of size: 1950 mm base diameter by 650 mm top surface diameter by 728 mm height having a slope of 48°. The top of the conical tank was at a height where the top surface diameter of the frustum reduced to one-third of the base diameter of the tank. The top surface diameter and the base diameter of the tank are in the ratio of 1:3. Volumetrically, this conical tank (1) is equivalent to a cylindrical tank of 1300 mm diameter and of the same height; thereby reducing the degree of radiation fire hazards by approximately one fourth as that of what prevails in the cylindrical tank of the diameter 1300 mm and of the same storage capacity. The fire of size 0.33 sq.m was extinguished in 3 seconds using dry chemical powder as a fire extinguishing agent.

Example 7

Fire was set on using diesel as a flammable liquid in a mild steel and of welded construction tank (1) of size: 1950 mm base diameter by 650 mm top surface diameter by 728 mm height having a slope of 48°. The top of the conical tank was at a height where the top surface diameter of the frustum reduced to one-third of the base diameter of the tank. The top surface diameter and the base diameter of the tank are in the ratio of 1:3. Volumetrically, this conical tank (1) is equivalent to a cylindrical tank of 1300 mm diameter and of the same height; thereby reducing the degree of radiation fire hazards by approximately one fourth as that of what prevails in the cylindrical tank of the diameter 1300 mm and of the same storage capacity. The fire of size 0.33 sq.m was extinguished in 3 seconds using dry chemical powder as a fire extinguishing agent.

Example 8

Fire was set on using mobil oil as a flammable liquid in a mild steel and of welded construction tank (1) of size: 1950 mm base diameter by 650 mm top surface diameter by 728 mm height having a slope of 48°. The top of the conical tank was at a height where the top surface diameter of the frustum reduced to one-third of the base diameter of the tank. The top surface diameter and the base diameter of the tank are in the ratio of 1:3. Volumetrically, this conical tank (1) is equivalent to a cylindrical tank of 1300 mm diameter and of the same height; thereby reducing the degree of radiation fire hazards by approximately one fourth as that of what prevails in the cylindrical tank of the diameter 1300 mm and of the same storage capacity. The fire of size 0.33 sq.m was extinguished in 3 seconds using dry chemical powder as a fire extinguishing agent.

The salient features of the above experiments are shown in Tables 2 and 3. From the above, it is clear that a fire in flammable liquid storage tank can successfully be extinguished by using the device of the present invention in a short span of time ranging from 3 to 5 seconds.

TABLE 2

Salient features of the experiments carried out using foam as a fire extinguishing agent.

| S. No. | Extinguishing Agent | Flammable Liquid | Size of Tank | Size of Fire (sq.m) | Extinguishment Time(s) |
|---|---|---|---|---|---|
| 1. | Protein-based Foam | Petrol | 1.95m × 0.65m × 0.728m | 0.33 | 5 |
| 2. | Protein-based Foam | Diesel | 1.95m × 0.65m × 0.728m | 0.33 | 4 |
| 3. | Protein-based Foam | Kerosene | 1.95m × 0.65m × 0.728m | 0.33 | 4 |
| 4. | Protein-based Foam | Mobil Oil | 1.95m × 0.65m × 0.728m | 0.33 | 4 |

TABLE 3

Salient features of the experiments carried out using dry chemical powder as a fire extinguishing agent.

| S. No. | Extinguishing Agent | Flammable Liquid | Size of Tank | Size of Fire (sq.m) | Extinguishment Time(s) |
|---|---|---|---|---|---|
| 1. | Sodium Bicarbonate based dry chemical powder | Petrol | 1.95m × 0.65m × 0.728m | 0.33 | 3.5 |
| 2. | Sodium Bicarbonate based dry chemical powder | Diesel | 1.95m × 0.65m × 0.728m | 0.33 | 3.0 |
| 3. | Sodium Bicarbonate based dry chemical powder | Kerosene | 1.95m × 0.65m × 0.728m | 0.33 | 3.0 |
| 4. | Sodium Bicarbonate based dry chemical powder | Mobil Oil | 1.95m × 0.65m × 0.728m | 0.33 | 3.0 |

The storage tank of the present invention is safer than the cylindrical tank under the condition when liquid in the adjoining tanks is burning and exposed to radiations from the tanks on fire as the top surface area of the proposed new tank (1) is smaller than that of the cylindrical tank of the same storage capacity. If this type of tank (1) catches fire, it will be emitting considerably lesser amount of radiations since the top surface burning area has been reduced to about one fourth than that of a cylindrical tank having same height and the same storage capacity. Moreover, it also reduces air entrainment to a considerable extent as compared to the cylindrical tank because of its conical construction as depicted in FIGS. 15 and 16, thus suffocating the fire and thereby reducing the rate of burning. Further, it will be easier to extinguish the fire as the size of fire will be considerably smaller than that of the cylindrical tanks. Moreover, it will be more stable as compared to cylindrical tanks as the base area will be about 9/4 times higher than that of the tank of the same height and the same storage capacity. The top cross-sectional area will be about one-fourth, depending upon the base-to-top diameter ratio. The fire extinguishing device being inbuilt in the storage tank is highly efficient in extinguishing fires of flammable liquids using foam and/or dry chemical powder extinguishants. For the fire of size 0.33 sq.m, the device, using foam as a fire extinguishing agent, takes about 4 to 5 seconds to extinguish the fire completely; and using dry chemical powder, the device takes about 3 to 3.5 seconds to knock down the fire completely. Besides these advantages, the storage tank of the present invention is simple and economical to fabricate and install with a minimum of labour and higher job safety, as well as to provide increased fire safety and security by minimizing the degree of fire hazards. Thus, altogether, it receives a fire safety rating of 95 by penalizing only 5 points on dependence for safety on mechanical appurtenances.

Advantages of the storage tank of the present invention are:

1. It is economical in design, erection and commissioning.

2. It enhances the fire safety rating to 95.

3. It reduces the vapourization losses to a considerable extent since its top surface area reduces to one-fourth to that of a cylindrical tank having same height and the same storage capacity.

4. It reduces the air entrainment to a considerable extent because of the reduced top surface diameter of the tank.

5. It reduces the rate of burning by suffocating the fire due to lower degree of air entrainment.

6. The roof of the tank considerably reduces the susceptibility to explosion, to fire from venting of vapours, to damage from fire exposure; and also its dependence on fire fighting efficiency and for safety on mechanical appurtenances.

7. The conical shell of the tank offers hydraulically leakproof storage for flammable liquids.

8. The bottom of the tank offers greater stability and hydraulically leakproof storage for flammable liquids.

9. The said fire extinguishing device is capable of extinguishing flammable liquid storage tank fires more efficiently than various types of presently available devices.

10. By using the cheapest foam concentrate available in the market, it accomplishes the fire extinguishment successfully and more efficiently.

11. By using the cheapest dry chemical powder available in the market, it accomplishes the fire extinguishment successfully and more efficiently.

12. For 0.33 sq.m size tank fire, foam device takes about 4 to 5 s to extinguish the fire completely; whereas dry chemical powder device takes about 3.0 to 3.5 s to extinguish the fire completely.

We claim:

1. An improved fixed roof flammable liquid storage tank with a fire extinguishing device, which comprises a conical tank (1) of slope ranging from 30° to 60° to the base having a stable and hydraulically leakproof bottom, and a conical circular wall (3) made of plurality of metal plates (4) joined together in continuation and in alignment to form upwardly and inwardly tapered conical wall (3) of the tank (1) up to a height where the top diameter reduces in the range of one-third to two-third of the base diameter of the tank to form a frustum, the joining of metal plates (4) being done in the manner so as to form leakproof joints (26) aligning toward the centre of the tank (1); the wall plates (4) are secured to a plurality of vertically spaced ring trusses (6), the diameter of which decreases in relation to the sloping angle as the distance from the base of the tank (1) increases; the conical section of the tank (1) is raised on a tier by tier basis up to a predetermined height by hoisting means (5); the top of the frustum having a pneumatically leakproof conical roof (8) of slope ranging from 3° to 4° to the frustum fixed to it; the fixing of the roof (8) being made on the frustum (7) supporting structure consisting of columns (16), girders (24), rafters and/or girder rings (25); the tank (1) being provided with a fire extinguishing device (2) consisting of one or more annular pipe ring(s) (9) capable of being fixed horizontally, concentrically and equidistantly from each other just above the bottom of the storage tank (1); the outermost annular pipe ring(s) (9) being connected to means (10 and 11) for supplying foam/dry chemical powder; the annular pipe ring(s) (9) having a plurality of diametrically connected cross-member pipes (12), the junction of the annular pipe rings (9) and cross-member pipes (12) being provided with vertical discharge pipes (13) of height such that the top ends of the pipes (13) are above the highest level (22) of the flammable liquid (23) in the storage tank (1); the vertical discharge pipes (13) having discharge nozzles (14) fixed to its top ends for the uniform discharge of foam/dry chemical powder onto the surface (22) of the flammable liquid (23) in the storage tank (1); the frustum (7) of the said tank (1) also being provided at its top with an emergency vent (15), a conservation vent and flame arrester (17), means for a water spray system (18), gauge hatch (19), and an inert gas vent (20); the tank (1) also being provided with means for earthing (21).

2. An improved storage tank as claimed in claim 1, wherein the slope of the conical tank is preferably 60°.

3. An improved storage tank as claimed in claim 1, wherein the fixed conical roof has a slope preferably of 3.6°.

4. An improved storage tank as claimed in claim 1, wherein the number of cross-member pipes is in the range of 2 to the number of annular pipe rings.

5. An improved storage tank as claimed in claim 1, wherein the height of the vertical discharge pipes is such that the top ends of the pipes having discharge nozzles, are at a distance in the range of 15 cm to 30 cm above the highest level of the flammable liquid in the storage tank.

* * * * *